US007429062B2

(12) United States Patent
Fan et al.

(10) Patent No.: US 7,429,062 B2
(45) Date of Patent: Sep. 30, 2008

(54) ANTI-COUNTERFEITING SEE-THROUGH MOIRE SECURITY FEATURE USING FREQUENCY-VARYING PATTERNS

(75) Inventors: Zhigang Fan, Webster, NY (US); Shen-ge Wang, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 120 days.

(21) Appl. No.: 10/284,545

(22) Filed: Oct. 30, 2002

(65) Prior Publication Data

US 2004/0084893 A1 May 6, 2004

(51) Int. Cl.
*B42D 15/10* (2006.01)
*B42D 15/00* (2006.01)

(52) U.S. Cl. ..... 283/72; 283/117; 428/916; 428/917

(58) Field of Classification Search ..... 283/72, 283/73, 85, 87, 91, 94, 99, 109, 113, 114, 283/117, 901; 428/916, 42.1, 915, 917; 40/453; 359/2

See application file for complete search history.

(56) References Cited

U.S. PATENT DOCUMENTS 4,504,083 A * 3/1985 Devrient et al. ..... 283/77
4,766,026 A * 8/1988 Lass et al. ..... 428/203
4,894,110 A * 1/1990 Lass et al. ..... 156/272.8
5,193,853 A * 3/1993 Wicker ..... 283/85
5,788,285 A * 8/1998 Wicker ..... 283/93
5,851,032 A * 12/1998 Green ..... 283/72
6,089,614 A * 7/2000 Howland et al. ..... 283/91
6,467,810 B2 * 10/2002 Taylor et al. ..... 283/72
6,494,491 B1 * 12/2002 Zeiter et al. ..... 283/91
6,991,260 B2 * 1/2006 Fan et al. ..... 283/72
7,315,407 B2 * 1/2008 Menz et al. ..... 359/2
2002/0117845 A1 * 8/2002 Ahlers et al. ..... 283/72
2004/0036272 A1 * 2/2004 Mathys ..... 283/72
2004/0150219 A1 * 8/2004 Allen et al. ..... 283/107

FOREIGN PATENT DOCUMENTS

EP 1291195 A1 * 3/2003

* cited by examiner

*Primary Examiner*—Derris H. Banks
*Assistant Examiner*—Pradeep C Battula
(74) *Attorney, Agent, or Firm*—Oliff & Berridge, PLC

(57) ABSTRACT

Frequency varying patterns are aligned on the front and back surfaces of a document to provide an anti-counterfeiting security device. The frequency varying patterns are reversed images. The document is sufficiently transparent to allow see-through of the pattern on the back of the document to be superimposed on the pattern on the front of the document. The frequency varying patterns will form a moire pattern if misaligned, regardless of the magnitude and the orientation of the misalignment.

12 Claims, 3 Drawing Sheets

ANTI-COUNTERFEITING SEE-THROUGH MOIRE SECURITY FEATURE USING FREQUENCY-VARYING PATTERNS

BACKGROUND OF THE INVENTION

The present invention relates generally to anti-counterfeiting patterns on a document and, more particularly, to a see-through moire pattern on a document which allows a document holder to verify the authenticity of the document and which has enhanced security protection against copying of the document.

A great number of printed documents require highly reliable means of ensuring their authenticity. These documents include currency, negotiable instruments, stock certificates, checks, tickets and the like. The means employed to indicate authenticity for the document should be permanent, durable, and difficult to replicate to allow the public at large to rely on the authenticity of the documents. This latter quality is particularly important to preclude, or at least to dissuade, attempts at counterfeiting the documents in order to ensure a maximum degree of confidence in the original document. In the case of banknotes, passports, checks, and other intrinsically valuable documents, confidence in the authenticity of the document is especially important, as any member of the public might become a holder or user of the document at any time.

The criteria for an effective document security feature are relatively easy to formulate. Such features should be difficult to replicate to deter potential counterfeiters. The features should permit ready detection by means available to ordinary holders or users of the final document. For banknotes and other documents on whose authenticity the public at large relies, the features should be discernible and verifiable under ordinary light conditions.

The increasing popularity of color photocopiers and other imaging systems, and the improving technical quality of color photocopiers, has led to an increase in the counterfeiting of such documentation.

A wide variety of security features for documents have been proposed previously. Examples of such security features include: optically variable devices, such as holograms and diffraction gratings; security threads or strips; microprint; watermarks; fine line or 'filigree' patterns; or color-shifting inks, fluorescent inks, and phosphorescent inks.

These measures naturally add to the complexity and production cost of the documents.

A disadvantage is that several of these document security features may require an optical filter or other external equipment, to provide the required lighting condition for verification of the security device. For example, fluorescent inks may require a source of ultraviolet light for their verification, and microprint, fine line and filigree patterns may require a magnifying lens for verification or may only be machine readable.

To prevent unauthorized duplication or alteration of documents, frequently special indicia or a background pattern are provided for document sheet materials. The indicia or background pattern is imposed upon the sheet material usually by some type of printing process such as offset printing, lithography, letterpress or other like mechanical systems, by a variety of photographic methods, by xerographic printing, and a host of other methods. Most of these patterns placed on sheet materials depend upon complexity and resolution to avoid ready duplication. Consequently, they add an increment of cost to the sheet material without being fully effective in many instances in providing the desired protection from unauthorized duplication or alteration.

It is an object of the present invention to provide a low cost, anti-counterfeiting pattern on a document which is easy to manufacture and yet difficult to counterfeit.

It is another object of the present invention to provide an anti-counterfeiting pattern on a document which a document user or holder with no additional external equipment can verify the authenticity of the document.

SUMMARY OF THE INVENTION

According to the present invention, frequency varying patterns are aligned on the front and back surfaces of a document to provide an anti-counterfeiting security device. The frequency varying patterns are reversed images. The document is sufficiently transparent to allow see-through of the pattern on the back of the document to be superimposed on the pattern on the front of the document. The frequency varying patterns will form a moire pattern if misaligned. As the patterns are varying in Frequency, a moire pattern will be formed regardless of the magnitude and orientation of the misalignment.

The patterns of lines can vary in frequency across the transverse distance of the lines or along the length of the lines. The patterns can be straight lines, asterisk, Fresnel concentric circles, alphanumeric characters of graphic illustrations.

Other objects and attainments together with a fuller understanding of the invention will become apparent and appreciated by referring to the following description and claims taken in conjunction with the accompanying drawings.

BRIEF DESCRIPTION OF THE DRAWINGS

A more complete appreciation of the invention and many of the attendant advantages thereof will be readily obtained and understood by referring to the following detailed description and the accompanying drawings in which like reference numerals denote like elements as between the various drawings. The drawings, briefly described below, are not to scale.

DETAILED DESCRIPTION

In the following detailed description, numeric ranges are provided for various aspects of the embodiments described. These recited ranges are to be treated as examples only, and are not intended to limit the scope of the claims hereof. In addition, a number of materials are identified as suitable for various facets of the embodiments. These recited materials are to be treated as exemplary, and are not intended to limit the scope of the claims hereof. In addition, the figures are not drawn to scale for ease of understanding the present invention.

Figure 1:
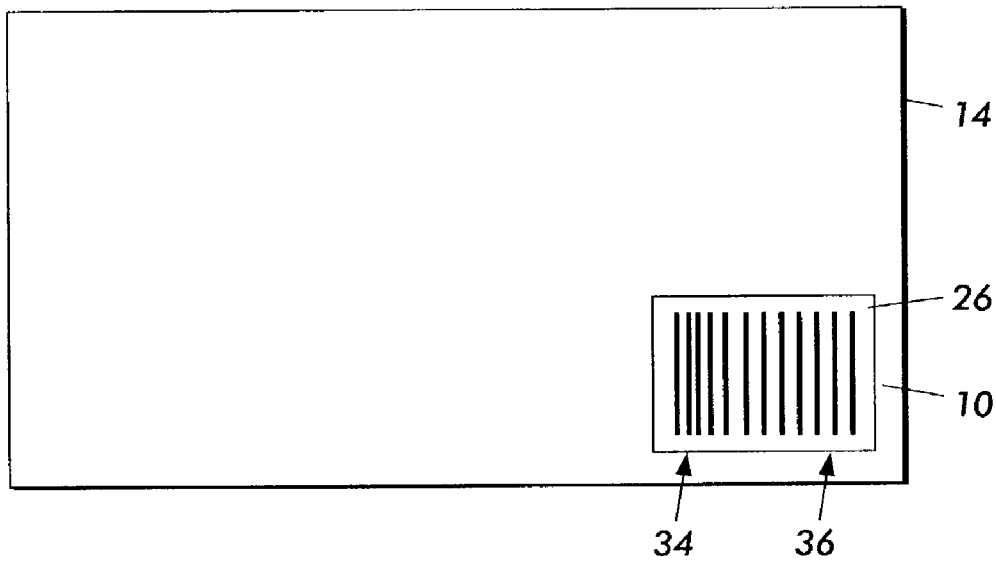
FIG. 1 is a front view of a document with a see-through pattern for an anti-counterfeiting security feature of the present invention.
Figure 2:
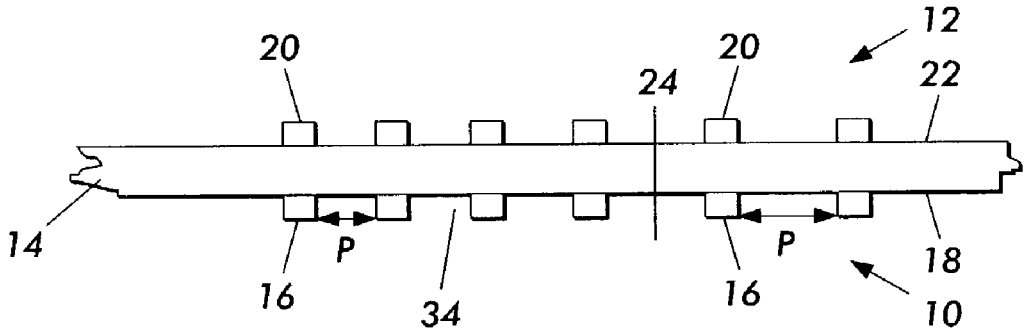
FIG. 2 is a top view of the document with a see-through pattern for an anti-counterfeiting security feature of FIG. 1.

Reference is now made to FIGS. 1 and 2, wherein there is illustrated a see-through moire pattern 10, 12 on a document 14 for an anti-counterfeiting security feature in accordance with this invention.

A first pattern 10 of lines 16 is on the front surface 18 of document 14. A second pattern 12 of lines 20 is on the back surface 22 of document 14.

The first and second patterns 10, 12 only cover a portion 26 of the front and back surface 18, 22 of the document 14. The document 14 will carry conventional printing (not shown) adjacent to the security feature portion 26.

The lines 20 of the second pattern 12 on the back surface 22 of document 14 are a mirror image, sometimes referred to as a reverse image, of the lines 16 of the first pattern 10 on the front surface 18 of document 14. The lines 16 and 20 are aligned with each other along relative to a normal 24 to the surfaces 18, 22 of the document 14.

The pitch or spacing p between the lines 16 will vary across the first pattern 10. The first pattern 10 has a varying line 16 frequency. Accordingly, the pitch p between the lines 20 will vary across the second pattern 12. The second pattern 12 has the same varying line 20 frequency as the first pattern 10.

The lines 16, 20 can be provided in any conventional manner using conventional inks such as black inks, colored inks, white inks, metallic inks, or optically variable inks.

An important aspect of the see-through moire pattern 10, 12 on the document 14 is its ability to permit verification of authenticity by any holder and under normal light conditions.

Figure 3:
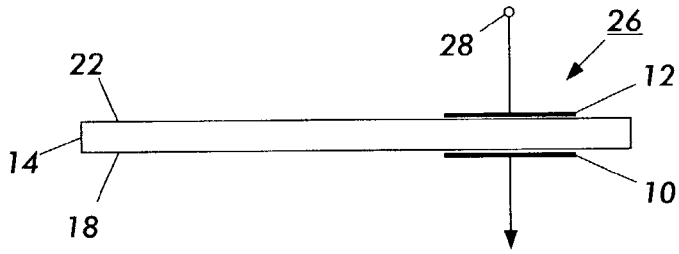
FIG. 3 is a top view of see-through of the patterns on the surfaces of the document of the present invention.

A shown in FIG. 3, the document 14 will be transparent enough, or alternately the security feature portion 26 with the patterns 10, 12 will be transparent enough, to permit see-through under normal light 28 by a document holder. The document 14 will typically be a paper such as rag paper and the like but could also comprise a plastics material such as a plastics film or other material such as credit card material, non-wovens and the like. Alternately, the security feature portion 26 will be defined by a plastic insert within a surrounding paper document 14.

A light beam 28, such as visible light in the range of wavelengths between about 380 and 720 nanometers, which is incident on the document 14 is either transmitted through the document, absorbed by the document, or reflected from the document. As represented by the line 30 in FIG. 3, transmitted light 28 enters the document through back surface 22, passes through the document 14, and emerges from the front surface 18.

An observer (not shown) viewing the document 14 from the front side 18 with the light 28 behind the back side 22 of the document will "see through" the document 14 and view the second pattern 12 of lines 20 superimposed on the first pattern 10 of lines 16.

Figure 4:
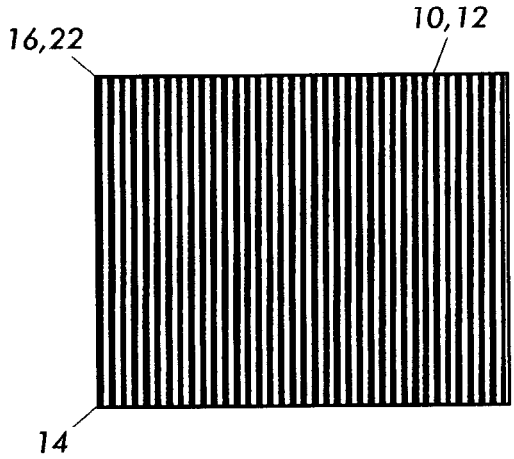
FIG. 4 is a front view of aligned parallel straight line patterns for an anti-counterfeiting security feature of the present invention.

As noted, the lines 16, 22 of the first and second patterns 10, 12 of document 14 are aligned with each other as shown in FIGS. 2 and 4.

Figure 5:
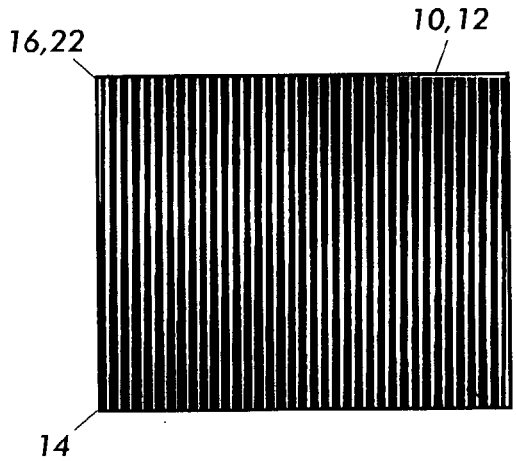
FIG. 5 is a front view of misaligned parallel straight line patterns forming a moire pattern for an anti-counterfeiting security feature of the present invention.

If the lines 16 of the first pattern 10 are misaligned with the lines 20 of the second pattern 12, then an observer will view a moire pattern 32 caused by the lines 16, 20 of the first and second patterns 10, 12 upon see-through of the document 14 with a light 28 behind the document, as shown in FIG. 5.

Printing of the lines 16, 22 of the patterns 10, 12 is normally carried out with specialized lithographic presses which allow simultaneous front and back surface 18, 22 printing during one printing run. In this way, the tolerances applied to the patterns 10, 12 are typically a fraction of a millimeter and any variation caused by counterfeiting by printing both sides 18, 22 during different printing runs can be quickly noticed. By printing on both sides 18, 22 in a single impression, misregister due to variations in the dimensions and thickness of the document 14 caused by change of moisture content or heating and the like are avoided. In all cases, the first and second patterns 10, 12 can be provided by printing such as offset, gravure or screen printing or by any other suitable technique such as a transfer process.

The primary advantage of a see-through security feature is the difficulty in counterfeiting such features. Partly, this is due to the need to achieve exact registration between the patterns on each side of the document and partly due to the fact that the counterfeiter may not even realize that the feature exists.

A high level of transparency for the document 14 is advantageous since it allows the use of fine line 16, 20 patterns 10, 12 which cannot normally be distinguished due to problems of light diffusion as light passes through the substrate. Specialty colors for the lines 16, 20 are desirable because they are more difficult for a counterfeiter to faithfully reproduce with a color copier, printer or scanner.

Moire patterns are interference fringes arising from two patterns 10, 12 of generally parallel lines 16, 20, the line patterns being superimposed upon one another with their lines intersecting and mutually inclined at a small angle.

Returning to FIGS. 1 and 2, the line frequency of the patterns 10, 12, i.e. the number of lines 16, 20 per unit of transverse distance, i.e. width of the pattern perpendicular to the lines, is varied to provide an area 34 of the document 14 in which the lines have a relatively high line frequency and so are closely spaced, and a further area 36 in which the lines have a relatively low line frequency and so are widely spaced.

Because of varying frequency and relative positions during see-through, the lines of the two patterns will make small and varied angles at the intersections between them over the area of the document if the lines are misaligned. The lines of the two patterns therefore interfere with one another to form moire effect interference fringes.

Moire fringe patterns 32 will appear as the crossing angle of the lines 16, 20 during see-through is varied from about one second of arc to about 45 degrees. The patterns 10, 12 consist of parallel lines 16, 20; but, if the two patterns of slightly different angles are superposed, moire fringes will appear.

Since the patterns 10, 12 are identical, the light beam 28 can be behind the front surface 18 of the document 14 and the viewer in front of the back side 22, the anti-counterfeiting security device of the present invention will also form a moire pattern 32 if the patterns 10, 12 are misaligned, regardless of the magnitude and the orientation of the misalignment.

The term "pattern" refers to all line patterns whether they be of an abstract, geometric or a representational nature. The first and second pattern by themselves is not a moire pattern. The first and second pattern if misaligned create a moire pattern Preferably, the first and second pattern each define a characteristic image. The first and second pattern defines recognizable patterns (such as security patterns) or images such as geometric shapes, graphic illustrations, alphanumeric characters and other curvilinear patterns. This enables the document easily to be authenticated either by the eye of the holder or by a machine in the case of a machine readable image.

Figure 6:
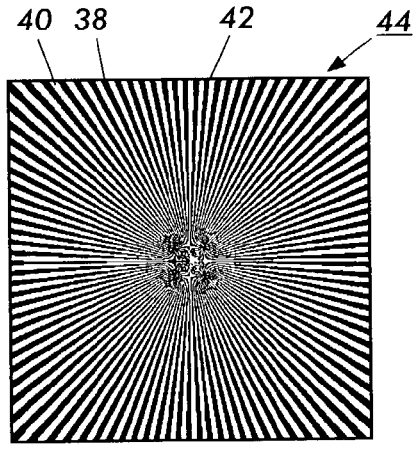
FIG. 6 is a front view of aligned asterisk line patterns for an anti-counterfeiting security feature of the present invention.
Figure 7:
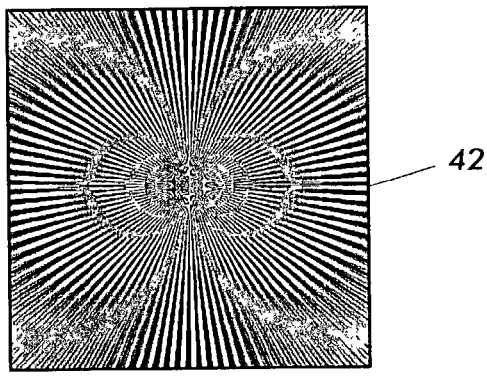
FIG. 7 is a front view of misaligned asterisk line patterns forming a moire pattern for an anti-counterfeiting security feature of the present invention.

As shown in FIG. 6, the pattern 38 of lines 40 on the front surface 42 of the document 44 form a plurality of straight lines extending radially from a central point, sometimes called an asterisk pattern or a starburst pattern. (The second identical reversed pattern on the back surface of the document is not shown in this Figure). The patterns vary in direction with the spacing p between adjacent lines 40 varying progressively along the line 40 length If aligned, the two patterns on the front and back surface of the document form a single image of the pattern 38 as shown in FIG. 6. If misaligned, the two patterns on the front and back surface of the document form a moire pattern 46 as shown in FIG. 7.

Figure 8:
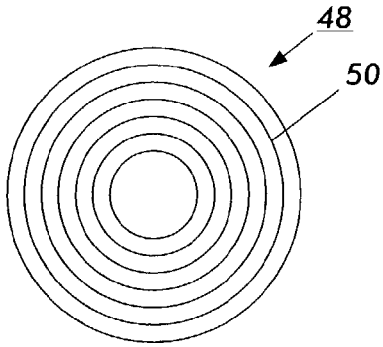
FIG. 8 is a front view of a fresnel pattern of concentric circular lines for an anti-counterfeiting security feature of the present invention.

Alternately as shown in FIG. 8, the pattern can be a Fresnel pattern 48 of concentric circular lines 50.

In this invention, see-through moires caused by frequency varying line patterns detect mis-registration from the front and back sides of documents. Moire does not exist in the original document where registration of the patterns is almost perfect. The patterns vary slowly in space, either in frequency, or in direction. The minimum misalignment can be detected by human visual resolution.

While the invention has been described in conjunction with specific embodiments, it is evident to those skilled in the art that many alternatives, modifications, and variations will be apparent in light of the foregoing description. Accordingly, the invention is intended to embrace all other such alternatives, modifications, and variations that fall within the spirit and scope of the appended claims.

What is claimed is:

1. A security feature for a document comprising a first pattern of a plurality of first lines of varying frequency, said first pattern on a first surface of said document, wherein the first lines of varying frequency are repetitive lines with a period of monotonically increasing or decreasing distance; and a second pattern of a plurality of second lines of varying frequency, said second pattern on a second surface of said document, said second surface of said document being opposite said first surface of said document, said second pattern being a reverse of said first pattern, said document being sufficiently transparent wherein said first pattern and said second pattern are see-through such that said first pattern and said second pattern can be viewed superimposed upon each other from said first surface of said document or said second surface of said document, wherein if said first pattern is aligned with said second pattern, said first pattern or said second pattern is visible, if said first pattern is misaligned with said second pattern because of a misalignment between said first and said second pattern on said document, a moire pattern is visible regardless of a magnitude and an orientation of the misalignment where the moire pattern is formed by said first pattern and said second pattern.

2. The security feature for a document of claim 1 wherein said first lines and said second lines vary in frequency across a transverse distance of said first lines and said second lines.

3. The security feature for a document of claim 1 wherein said first lines and said second lines vary in frequency across a length of said first lines and said second lines.

4. The security feature for a document of claim 1 wherein said first pattern and said second pattern are straight lines.

5. The security feature for a document of claim 1 wherein said first pattern and said second pattern are concentric circular lines.

6. The security feature for a document of claim 1 wherein said first pattern and said second pattern are a plurality of straight lines extending radially from a central point.

7. The security feature for a document of claim 1 wherein said first pattern and said second pattern are alphanumeric characters.

8. The security feature for a document of claim 1 wherein said first pattern and said second pattern are graphic illustrations.

9. The security feature for a document of claim 1 wherein said first pattern and said second pattern are adjacent to printing on the first surface and the second surface of said document.

10. A security feature for a document comprising a first pattern of a plurality of first lines of varying frequency, said first pattern on a first surface of said document, wherein the first lines of varying frequency are repetitive lines with a period of monotonicallv increasing or decreasing distance; and a second pattern of a plurality of second lines of varying frequency, said second pattern on a second surface of said document, said second surface of said document being opposite said first surface of said document, said second pattern being a reverse of said first pattern, said document being sufficiently transparent at said first pattern and said second pattern wherein said first pattern and said second pattern are see-through such that said first pattern and said second pattern can be viewed superimposed upon each other from said first surface of said document or said second surface of said document, wherein if said first pattern is aligned with said second pattern, said first pattern or said second pattern is visible, if said first pattern is misaligned with said second pattern because of a misalignment between said first and said second pattern on said document, a moire pattern is visible regardless of a magnitude and an orientation of the misalignment where the moire pattern is formed by said first pattern and said second pattern.

11. The security feature for a document of claim 10 wherein said first pattern and said second pattern are on a plastic area of said document.

12. The security feature for a document of claim 11 wherein said document surrounding said first pattern and said second pattern is paper.

* * * * *